US007473140B2

(12) United States Patent
Guan et al.

(10) Patent No.: US 7,473,140 B2
(45) Date of Patent: Jan. 6, 2009

(54) CARD EDGE CONNECTOR

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/899,198

(22) Filed: Sep. 5, 2007

(65) Prior Publication Data

US 2008/0057792 A1 Mar. 6, 2008

(51) Int. Cl.
*H01R 24/00* (2006.01)

(52) U.S. Cl. ..... 439/637

(58) Field of Classification Search ..... 439/637, 439/607, 608, 157

See application file for complete search history.

(56) References Cited

U.S. PATENT DOCUMENTS 5,041,023 A * 8/1991 Lytle ..... 439/637
5,511,985 A * 4/1996 Noschese et al. ..... 439/157
5,580,257 A * 12/1996 Harwath ..... 439/108
5,730,609 A * 3/1998 Harwath ..... 439/108
5,813,883 A * 9/1998 Lin ..... 439/637
5,961,346 A * 10/1999 Choy ..... 439/567
5,964,606 A 10/1999 Choy
6,012,952 A * 1/2000 Choy et al. ..... 439/637
6,116,917 A 9/2000 Choy
6,176,723 B1 * 1/2001 Sakata et al. ..... 439/326
6,343,018 B1 * 1/2002 Takeyama et al. ..... 361/737
6,419,503 B1 * 7/2002 Choy ..... 439/79
6,540,540 B1 * 4/2003 Tobey ..... 439/327
6,663,406 B1 * 12/2003 Wu ..... 439/326
6,666,717 B1 * 12/2003 Choy ..... 439/541.5
6,830,470 B1 12/2004 Lynch et al.

* cited by examiner

*Primary Examiner*—T C Patel
*Assistant Examiner*—Vladimir Imas
(74) *Attorney, Agent, or Firm*—Wei Te Chung

(57) ABSTRACT

A card edge connector (100) includes an insulative housing (1) having a pair of side walls (16) with a central slot (12) formed therebetween and a number of upper cavities (13) and lower cavities (14), the central slot defining a central line (125) along a middle portion thereof, the upper cavities and the lower cavities being located on opposite sides of the central line; a number of contacts each including a contacting portion (211, 221, 231, 241) extending into the central slot, a soldering portion (213, 223, 233, 243) extending out of the housing and a fixing portion (212, 222, 232, 242) interconnecting the contacting portion and the soldering portion, said contacts having upper contacts and lower contacts received in the upper cavities and the lower cavities respectively, the lower contacts comprising a first row contacts (21) and a second row contacts (22), the fixing portions (212) of the first row contacts and the fixing portions (222) of the second row contacts being located on opposite sides of the central line respectively.

18 Claims, 4 Drawing Sheets

CARD EDGE CONNECTOR

BACKGROUND OF THE INVENTION

1. Field of the Invention

The present invention generally relates to a card edge connector for receiving a module and more particularly to an angled card edge connector.

2. Description of Related Art

A card edge connector is used to hold a memory module and to electrically couple such module to a mother printed circuit board on which the card edge connector is mounted, nowadays, the card edge connector is designed to be angled with respect to the mother printed circuit board, thus reducing the height of the card edge connector. Such connector is disclosed in U.S. Pat. No. 5,964,606 and comprises an insulative housing defining a central slot with a plurality of upper contacts and low contacts positioned on an upper and a low sides of said central slot respectively, the upper contacts and the low contacts each defines an upper retention portion and a lower retention portion which are interferentially fixed with the housing, the lower retention portions is secured with bottom portions of a lower side wall of the housing, that is to say, the lower retention portions is located at a relatively lower portion of the housing. In order to further reduce the height of the housing, bottom portions of the lower side wall is to be cut away, in this way, the lower contacts can not be retained by the housing.

It is thus desired to provide a card edge connector to overcome the shortcomings described above.

SUMMARY OF THE INVENTION

An object of the present invention is to provide a card edge connector of low height.

In order to achieve above-mentioned object, a card edge connector for receiving a module, comprises: an insulative housing having a pair of side walls with a central slot formed therebetween and a plurality of upper cavities and lower cavities, the central slot defining a central line along a middle portion thereof, the upper cavities and the lower cavities being located on opposite sides of the central line; a plurality of contacts each including a contacting portion extending into the central slot, a soldering portion extending out of the housing and a fixing portion interconnecting the contacting portion and the soldering portion, said contacts having upper contacts and lower contacts received in the upper cavities and the lower cavities respectively, the lower contacts comprising a first row contacts and a second row contacts, the fixing portions of the first row contacts and the fixing portions of the second row contacts being located on opposite sides of the central line respectively.

Other objects, advantages and novel features of the present invention will become more apparent from the following detailed description of the present embodiment when taken in conjunction with the accompanying drawings.

DETAILED DESCRIPTION OF THE INVENTION

Figure 1:
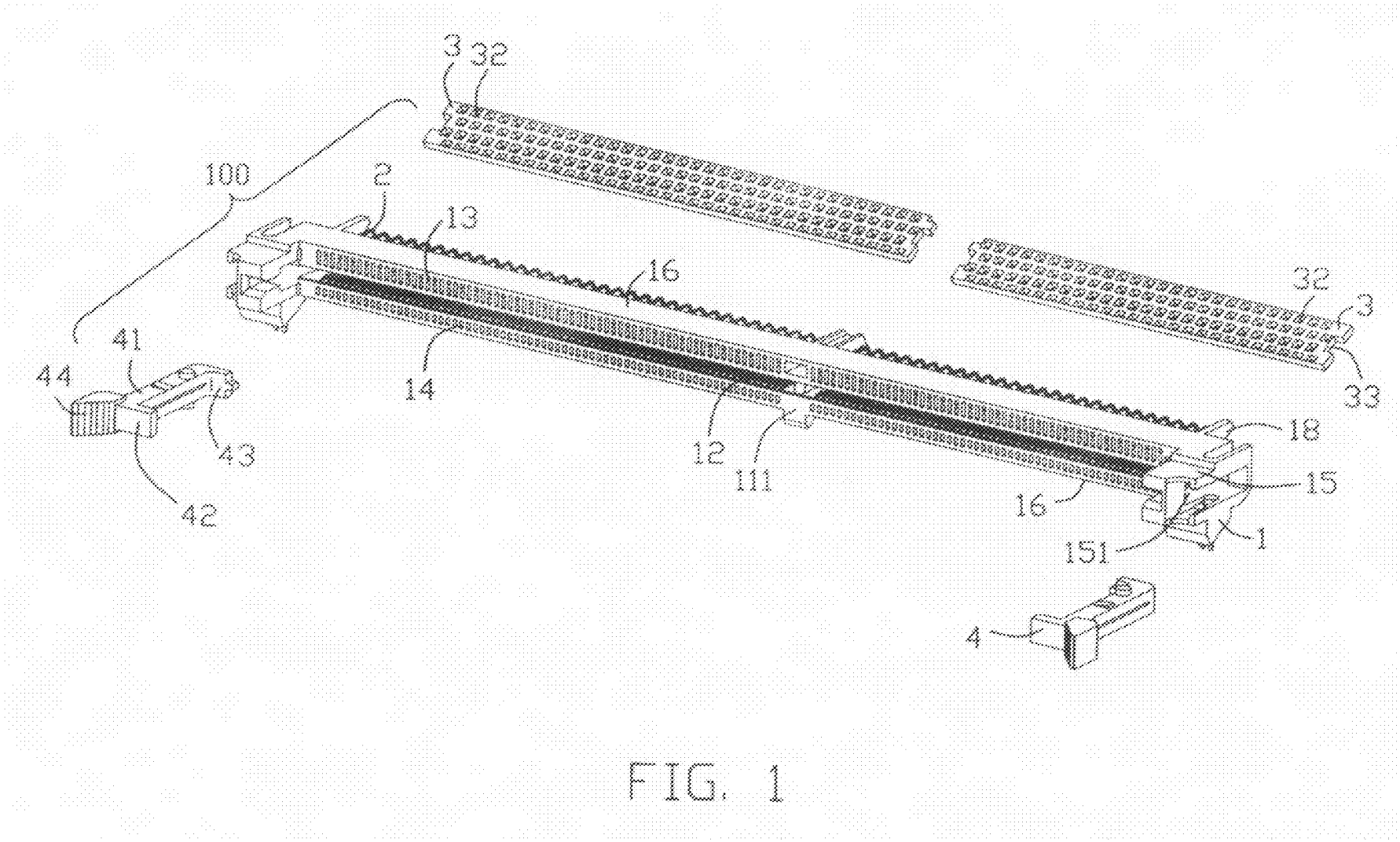
FIG. 1 is an exploded perspective view of a card edge connector according to the present invention.
Figure 2:
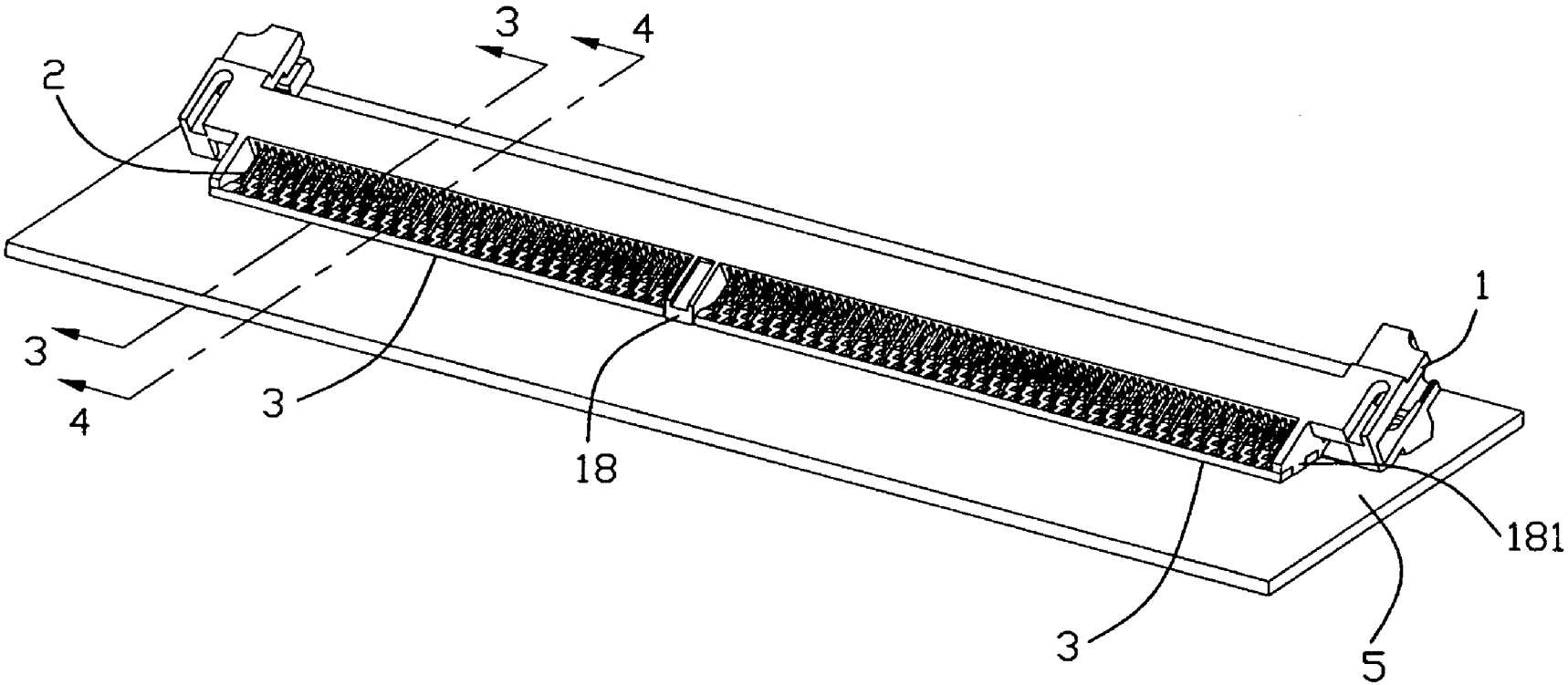
FIG. 2 is an assembled perspective view of the card edge connector with ejector being removed and a mother printed circuit board on which the card edge connector is mounted.
Figure 3:
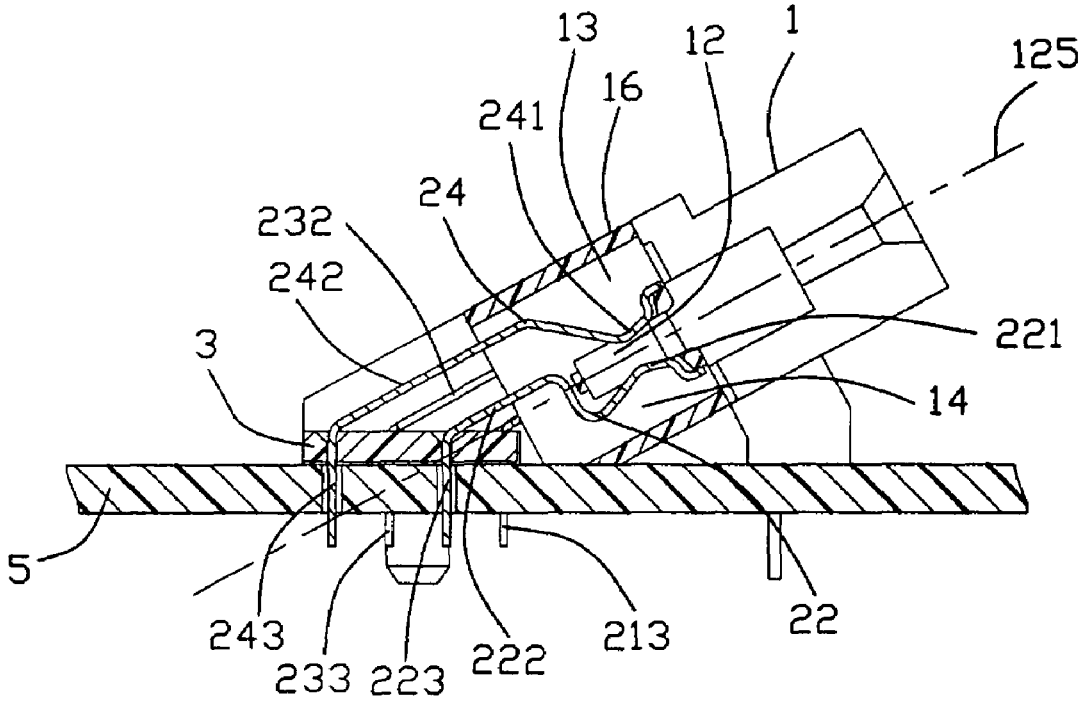
FIG. 3 is a cross-sectional view of the card edge connector and the mother printed circuit board taken along line 3-3 of FIG. 2.

Reference will now be made to the drawing figures to describe the preferred embodiment of the present invention in detail.

Figure 4:
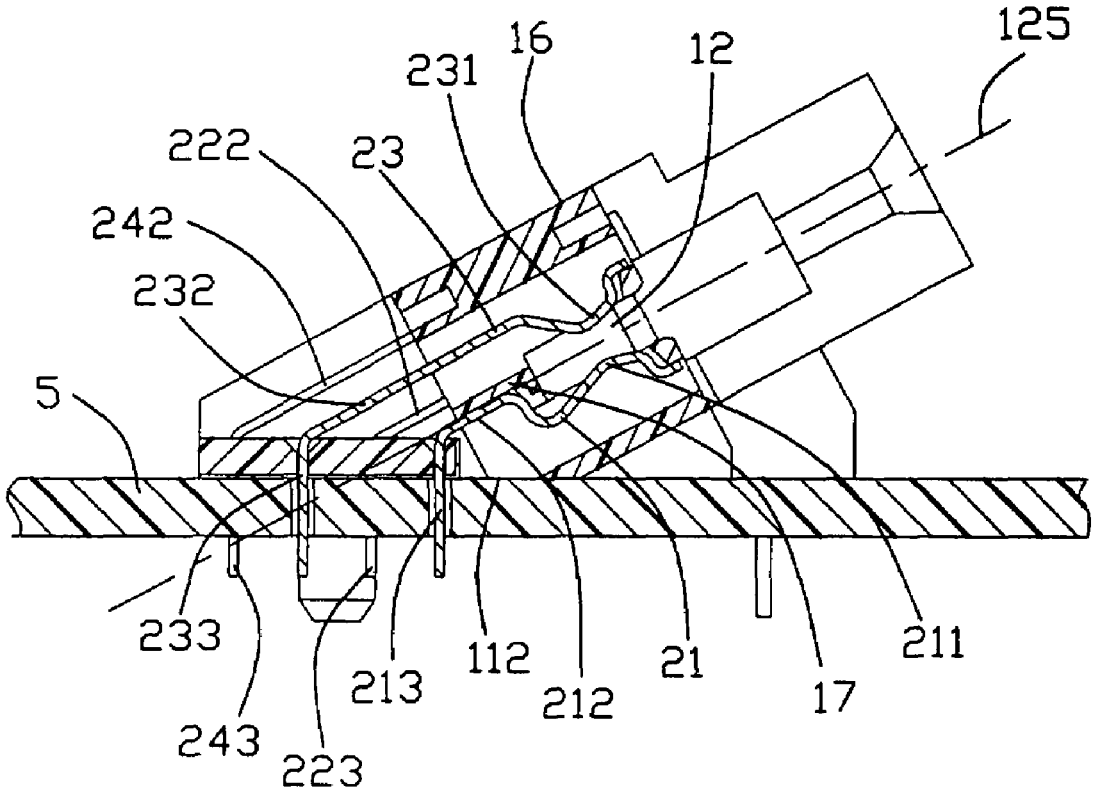
FIG. 4 is a cross-sectional view of the card edge connector and the mother printed circuit board taken along line 4-4 of FIG. 2.

Referring to FIGS. 1-4, the card edge connector 100 according to the present invention is mounted on a mother printed circuit board 5, comprises an elongated housing 1 having a pair of longitudinal side walls 16 extending along a lengthwise direction thereof, a pair of end walls 15 extending from opposite ends of the side walls 16, an elongated central slot 12 formed therebetween for receiving a corresponding memory module (not shown) therein. The side walls 16 have a mating face 111 from which the central slot 12 are recessed and a mounting face 112 for mounting on the mother printed circuit board 5. It is noted that as shown in FIG. 4 housing 1 essentially defines a cutout, where the reference numeral 112 points to, which invades the lower row cavity 14 to form a chamfer-like structure at the bottom corner of the lower row passageway 14. A central dashed line 125 is defined along a middle portion of the central elongated slot 12 for illustrating purpose, the central dashed line 125 extends at an acute angle with respect to the mounting face 112. Upper cavities 13 and lower cavities 14 are provided on opposite sides of the central dashed line 125 for retaining respective angled contacts 2 therein.

The contacts 2 have lower contacts including a first row contacts 21 and a second row contacts 22, and upper contacts comprising a third row contacts 23 and a fourth row contacts 24. The fourth row contacts 24 and the third row contacts 23 are received in the upper cavities 13 and each defines a fourth row contacting portion 241 and a third row contacting portion 231, a fourth row fixing portion 242 and a third row fixing portion 232, a fourth row soldering portion 243 and a third row soldering portion 233 respectively. The fourth row contacting portions 241 and the third row contacting portions 231 are alternatively arranged and aligned with each other along a lengthwise direction of the housing 1, and extend into the central slot 12 for contacting with the memory module.

The fourth row fixing portion 242 connect the fourth row contacting portion 241 and the fourth row soldering portion 243, the third row fixing portion 232 connect the third row contacting portion 231 and the third row soldering portion 233. The fourth row fixing portions 242 and the third row fixing portions 232 interferentially engage with inner walls of the upper cavities 13. The fourth row fixing portions 242 and the third row fixing portions 232 are positioned above the central dashed line 125 along a height direction of the housing 1, and the fourth row fixing portions 242 are located above the third row fixing portions 232. The fourth row fixing portions 242 define a fourth plane, the third row fixing portions 232 define a third plane which is parallel to the fourth plane.

The second row contacts 22 and the first row contacts 21 are received in the lower cavities 14 and each defines a second row contacting portion 221 and a first row contacting portion 211, a second row fixing portion 222 and a first row fixing portion 212, a second row soldering portion 223 and a first row soldering portion 213 respectively. The second row contacting portions 221 and the first row contacting portions 211 are alternatively arranged and aligned with each other along a lengthwise direction of the housing 1, and extend into the central slot 12 for contacting with the memory module.

The second row fixing portion 222 connect the second row contacting portion 221 and the second row soldering portion 223, the first row fixing portion 212 connect the first row contacting portion 211 and the first row soldering portion 213. The second row fixing portions 222 extend into the upper cavities 13 and interferentially engage with inner walls thereof, the first row fixing portions 212 interferentially engage with inner walls of the lower cavities 14. The second row fixing portions 222 define a second piano located above the central dashed line 125 along the height direction of the housing 1, the first row fixing portions 212 define a first plane which is parallel to the second plane. The first row fixing portions 212 are positioned below the central dashed line 125 and parallel to the second row fixing portions 222. The second row fixing portions 222 are located above the central dashed line 125, that is to say, the fourth row fixing portions 242, the third row fixing portions 232 and the second row fixing portions 222 lie on an upper side of the central dashed line 125, and the first fixing portions 212 lies on a lower side of the central dashed line 125 and being adjacent to the central dashed line 125 to be fixed on a substantially middle portion of the insulative housing 1. A position wall 17 is formed between the upper cavities 13 and the lower cavities 14, the first row fixing portions 212 abuts against a lower surface of the position wall 17. In an alternative embodiment, the first row fixing portions 212 can upwardly extend beyond the central dashed line 125.

An ejector 4 is rotatably mounted on the end wall 15 of the housing 1, and includes a base portion 41, a locking portion 42 extending inwardly from an upper end of the base portion 41 for retaining the memory module, an ejecting portion 43 projecting from a bottom end of the base portion 41, a gripping portion 44 extending outwardly in a direction opposite to the locking portion 42. The end wall 15 defines a receiving room 151 communicating with the central slot 12 for accommodating the ejector 4, the ejecting portion 43 extends into the central slot 12 to eject the memory module from the central slot 12.

The housing 1 further defines a plurality of retaining blocks 18 extending from a rear face thereof, a pair of spacers 3 are sandwiched between the adjacent retaining blocks 18 and each has four rows through holes 32 for aligning respective first soldering portions 213, second soldering portions 223, third soldering portions 233, fourth soldering portions 243 of the contacts 2 therein, thereby facilitating insertion of the contacts 2 into corresponding holes on the mother printed circuit board 5. The spacer 3 has a pair of cutouts 33 for locking with tabs 181 protruding from a bottom side of the retaining blocks 18.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a module, comprising:

an insulative housing having a pair of side walls with a central slot formed therebetween and a plurality of upper cavities and lower cavities, the central slot defining a central line along a middle portion thereof, the upper cavities and the lower cavities being located on opposite sides of the central line;

a plurality of contacts each including a contacting portion extending into the central slot, a soldering portion extending out of the housing and a fixing portion interconnecting the contacting portion and the soldering portion, said contacts having upper contacts and lower contacts received in the upper cavities and the lower cavities respectively, the lower contacts comprising a first row contacts and a second row contacts, the fixing portions of the first row contacts and the fixing portions of the second row contacts being located on opposite sides of the central line respectively.

2. The card edge connector as claimed in claim 1, wherein the fixing portions of the first row contacts are positioned below the fixing portions of the second row contacts along a height direction of the housing.

3. The card edge connector as claimed in claim 1, wherein the fixing portions of the upper contacts are positioned above the fixing portions of the second row contacts along a height direction of the housing.

4. The card edge connector as claimed in claim 1, wherein the first row contacts and the second row contacts are alternatively arranged in the lower cavities, the contacting portions of the first row contacts and the contacting portions of the second row contacts are aligned with each other along a lengthwise direction of the housing.

5. The card edge connector as claimed in claim 4, wherein the fixing portions of the first row contacts commonly define a first plane, the fixing portions of the second row contacts commonly define a second plane which is parallel to the first plane.

6. The card edge connector as claimed in claim 1, wherein a position wall is formed between the upper cavities and the lower cavities, the fixing portions of the first row contacts abut against a lower portion of the position wall.

7. The card edge connector as claimed in claim 1, wherein the housing defines a mounting face on a lower portion thereof and a mating face, the central slot is recessed from the mating face, the mating face is oblique to the mounting face, the central line is angled with respect to the mounting face.

8. The card edge connector as claimed in claim 1, further comprising a spacer defining a plurality of through holes for aligning the soldering potions.

9. The card edge connector as claimed in claim 8, wherein the housing has a plurality of retaining blocks, the spacer is sandwiched between the adjacent retaining blocks.

10. The card edge connector as claimed in claim 9, wherein the spacer has a pair of cutouts, the retaining blocks have a plurality of tabs for locking with the corresponding cutouts.

11. A card edge connector for receiving a module, comprising:

an insulative housing having an upper side wall, a lower side wall with a central slot formed therebetween and a plurality of upper cavities and lower cavities, The central slot defining a central line along a middle portion thereof, the upper cavities and the lower cavities being located on opposite sides of the central line;

a plurality of contacts each including a contacting portion extending into the central slot, a soldering portion extending out of the housing and a fixing portion interconnecting the contacting portion and the soldering portion, said contacts having upper contacts and lower contacts received in the upper cavities and the lower cavities respectively, the fixing portions of the lower contacts are spaced apart from the lower side wall along a height direction of the insulative housing to be fixed on a substantially middle portion of the insulative housing, the lower contacts having a first row contacts and a second row contacts, the fixing portions of the second row contacts upwardly extending beyond the central line to be located above the fixing portions of the first row contacts.

12. The card edge connector as claimed in claim 11, wherein the fixing portions of the first row contacts commonly define a first plane, the fixing portions of the second row contacts commonly define a second plane which is parallel to the first plane.

13. The card edge connector as claimed in claim 11, wherein the housing defines a mounting face on a lower portion thereof and a mating face, the central slot is recessed from the mating face, the mating face is oblique to the mounting face, the central line is angled with respect to the mounting face.

14. A slanted card edge connector comprising:

an insulative elongated housing defining along a longitudinal direction upper and lower elongated side walls with a middle slot therebetween in a transverse direction, which is perpendicular to said longitudinal direction, said middle slot upwardly exposed to an exterior in the oblique direction;

two upper and lower rows of passageways defined in the corresponding two side walls, respectively; and a plurality of contacts respectively located in the corresponding passageways; wherein the housing in the lower side wall defines a cutout, which invades the corresponding passageways in the lower row so as to form a chamfer-like structure at a bottom corner of each of said passageways in the lower row, thus lowering a profile of the housing on a printed circuit board on which the connector is mounted, a position wall is located under the middle slot in said oblique direction, and the position wall defines a first bottom end thereof, the lower elongated side walls define a second bottom end thereof which extends downwardly along the oblique direction while being terminated before reaching the first bottom end due to said cutout.

15. The slanted card edge connector as claimed in claim 14, wherein the contact disposed in the passageway in the lower side wall, defines a retention section for holding the contact in position in the passageway, under a condition that the retention section is located under the middle slot along said oblique direction.

16. The slanted card edge connector as claimed in claim 14, wherein the upper side wall is thicker than the lower side wall.

17. The slanted card edge connector as claimed in claim 14, wherein the passageways in the upper side wall form two different types alternately arranged along the longitudinal direction thereof.

18. The slanted card edge connector as claimed in claim 17, wherein said two different types includes a wider one and a narrow one in said transverse direction.

* * * * *